United States Patent [19]

Jestädt et al.

[11] Patent Number: 4,932,121

[45] Date of Patent: Jun. 12, 1990

[54] LONG-HAIR TRIMMING DEVICE FOR DRY SHAVING APPARATUS

[75] Inventors: Albrecht Jestädt, Friedrichsdorf; Klaus Oprach, Schwalbach; Gerhard Schäfer, Frankfurt, all of Fed. Rep. of Germany

[73] Assignee: Braun Aktiengesellschaft, Kronberg, Fed. Rep. of Germany

[21] Appl. No.: 356,332

[22] Filed: May 23, 1989

[30] Foreign Application Priority Data

Jun. 4, 1988 [DE] Fed. Rep. of Germany ..... 3819055

[51] Int. Cl.[5] ..... B26B 19/10

[52] U.S. Cl. ..... 30/34.1; 30/43.92

[58] Field of Search ..... 30/34.1, 43.92, 210, 30/212–214, 43.91

[56] References Cited

U.S. PATENT DOCUMENTS 3,222,781 12/1965 Luther et al. ..... 30/210
4,262,415 4/1981 Braun ..... 30/34.1
4,577,408 3/1986 Tietjens ..... 30/210 X

FOREIGN PATENT DOCUMENTS 3303989 6/1984 Fed. Rep. of Germany .

*Primary Examiner*—Douglas D. Watts
*Attorney, Agent, or Firm*—Fish & Richardson

[57] ABSTRACT

The invention is directed to a long-hair trimming device for dry shaving apparatus, with a cutting comb arranged fast with a housing and having an abutment surface for engagement with an abutment surface of a cutting blade which is coupled to a carrier body via at least one driving member, the carrier body being adapted to be driven by a drive means, and with at least one pressure spring bearing with one end against the carrier body while its other end takes support upon the housing, wherein the carrier body provides on the side close to the cutting teeth of the cutting blade a slightly protruding seating edge made of a plastics material and having its cross-sectional profile tapering in the direction of the cutting blade, wherein the seating edge rests against the cutting blade in the area of the root of the cutting teeth, and wherein an optimum abutting engagement of the cutting blade with the cutting comb is accomplished by deformation of the seating edge and the cutting blade by means of the force the pressure spring exerts through the carrier body on the seating edge and on the cutting blade.

7 Claims, 3 Drawing Sheets

LONG-HAIR TRIMMING DEVICE FOR DRY SHAVING APPARATUS

This invention relates to a long-hair trimming device for dry shaving apparatus, with a cutting comb arranged fast with a housing and having an abutment surface for engagement with an abutment surface of a cutting blade which is coupled to a carrier body via at least one driving member, the carrier body being adapted to be driven by a drive means, and with at least one pressure spring bearing with one end against the carrier body while its other end takes support upon the housing.

A long-hair trimming device of this type is known from DE No. 33 03 989 C 2. To produce keen cutting edges on the cutting teeth, both the cutting combs and the cutting blades of long-hair trimming devices have their respective abutting sides face-ground. Due to the relatively thin wall thickness of these cutting parts, the release and removal of the cutting parts firmly held and face-ground in the cutting fixture results in a material warpage in the form of a slight curvature which opposes a plane abutting engagement of the cutting parts over their entire longitudinal extent. The curvatures of the cutting parts thus resulting from the grinding operation and extending in opposite directions with the long-hair trimmer assembled, cause an uneven distribution of the forces exerted on the carrier body by the pressure springs because the abutting engagement occurs at the ends of their longitudinal extent.

It is an object of the present invention to provide a long-hair trimming device of the type initially referred to in which in assembled condition an optimum abutting engagement is accomplished automatically between the cooperating cutting areas of cutting comb and cutting blade over their longitudinal extent.

According to the invention, this requirement is satisfied in a long-hair trimming device of the type initially referred to in that the carrier body provides on the side close to the cutting teeth of the cutting blade a slightly protruding seating edge made of a plastics material and having its cross-sectional profile tapering in the direction of the cutting blade, that the seating edge rests against the cutting blade in the area of the root of the cutting teeth, and that relative abutting engagement of the cutting blade and the cutting comb can be accomplished by the deformation of the seating edge and the cutting blade by means of the force the pressure spring exerts through the carrier body on the seating edge and on the cutting blade.

The solution according to the invention distinguishes itself by a good relative abutment of the cutting areas of cutting blade and cutting comb over their entire longitudinal extent, which abutment occurs automatically in the assembled condition of the long-hair trimming device, as a result of which the cutting performance is substantially improved. Warpage of material as it results from the manufacture of cutting blade and cutting comb is compensated for by means of deformation of the seating edge made of a plastics material as well as of the cutting blade.

In a particularly advantageous embodiment of the invention, the seating edge is formed integral with the carrier body.

The cross-sectional profile of the seating edge is preferably triangular.

In an embodiment of the invention, the seating edge, in extending in an elongation of the side wall of the carrier body, is provided on the upper side wall thereof.

In a preferred embodiment of the invention, the seating edge is arranged to protrude relative to the upper side wall and the front side wall.

A particularly good abutting engagement between the cutting areas of cutting comb and cutting blade is accomplished by the invention in that the seating edge is both elastically and plastically deformable.

Conveniently, the cutting blade has a low moment of resistance in the direction of action of the pressure springs.

Further advantages and details of the invention will become apparent from the subsequent description and the accompanying drawings showing preferred embodiments of a long-hair trimming device. In the drawings, FIG. 1 is a side view of a cutting head frame with a partially cutaway area in the region of the long-hair trimming device;

Figure 1:
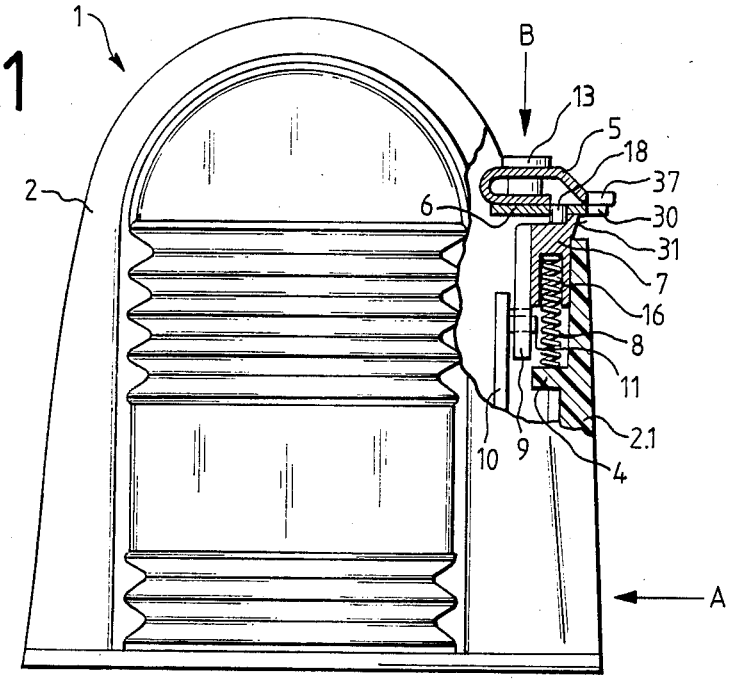

Referring now to FIG. 1, reference numeral 1 identifies a cutting head frame of a dry shaving apparatus, reference numeral 2 designates a housing shown partly in section, and reference numeral 3 denotes an end wall. A support strip 4 extending in longitudinal direction is formed on the inside of the housing wall 2.1.

The long-hair trimming device includes a fixed cutting comb 5, a movable cutting blade 6 coupled to a carrier body 7, as well as pressure springs 8 bearing against the support strip 4, and a fork 9 formed on the carrier body 7.

The long-hair trimming device is shown in the operating state. The slidable drive lever 10 with the driving pin 11 formed thereon is located in the U-shaped opening of the fork 9, transmitting in this manner the oscillating motion of the drive lever 10, in the ON state, to the movable cutting blade. When the drive lever 10 is displaced in the direction of arrow B, the driving pin 11 slides out of the fork 9, causing the long-hair trimmer to stop.

Figure 2:
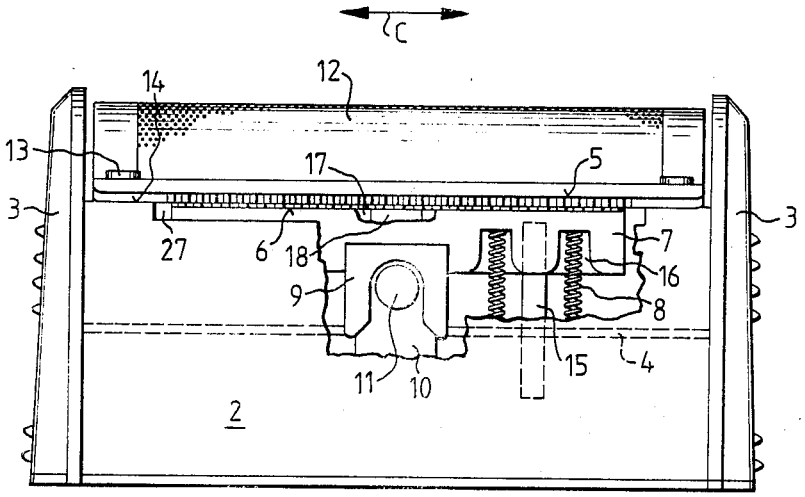
FIG. 2 is a front view of a cutting head frame, as seen from the direction of arrow A in FIG. 1, with a cutting foil and a long-hair trimming device and a partially cutaway area in the front housing wall.

The cutting foil 12 is held in the cutting head frame 1 in known fashion, while the fixed cutting comb 5 is fastened by means of two screws or rivets 13 to a molding 14 provided on the cutting head frame 1, as clearly shown in FIG. 2. The housing wall 2.1 of the housing 2 of the cutting head frame terminates a short distance below the movable cutting blade 6, thereby producing a narrow gap 27 through which part of the carrier body 7 is visible over its entire longitudinal extent. The partially cutaway area in the housing wall 2.1 makes it possible to recognize the drive lever 10 with the driving pin 11, the fork 9, the carrier body 7, two pressure springs 8 and one guide strip 15, to the extent that they are revealed in the partially cutaway area.

The pressure springs 8 bear against the support strip 4 shown in dashed lines, said strip being provided on the inside of the housing wall 2.1 of the cutting head frame, and extend with their opposite ends into recesses 16 provided on the carrier body 7. These recesses 16 define the position and the center of pressure of the pressure spring 8 in the carrier body 7, in addition to serving a guiding function and facilitating the assembly of these interengaging components. Preferably, the longhair trimming device shown provides four recesses 16 in the carrier body 7 and four pressure springs 8.

A guide strip 15 is visible through the partially cutaway area, the purpose of said strip being to maintain the carrier body 7 in its sliding position, that is, prevent a movement or excursion of the carrier body 7 in the direction of the arrow A in FIG. 1.

Starting at the center line, the partially cutaway area shows only the right-hand side of the carrier body 7 with the guide strip 15 and two pressure springs 8. It will be understood that the left-hand side is a mirror image thereof.

Above the fork 9, a cutout is provided on the carrier body 7 through which cutout the driving member 18 formed on the carrier body and coupling the cutting blade 6 to the carrier body is visible.

Alternatively, it is also possible to provide a two- or three-point mounting of the cutting blade on the carrier body 7. The receiving openings 21 in the cutting blade 6 have to be conformed to the contours of the driving member or members 18, with the driving members engaging with zero clearance into the receiving openings in the direction of movement C of the cutting blade 6.

Figure 3:
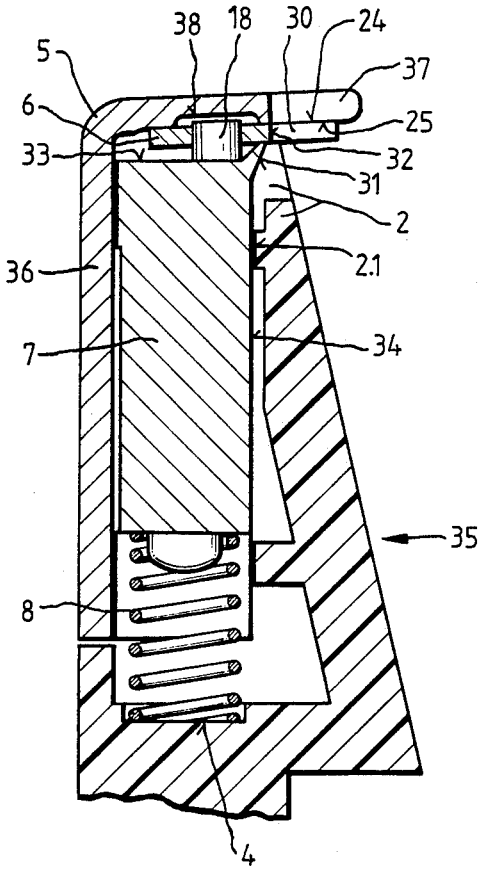
FIG. 3 is a sectional view of a long-hair trimming device which is accommodated in a slide switch.
Figure 5:
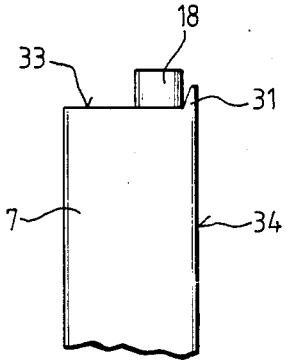
FIG. 5 is a view of the upper part of a carrier body with a seating edge.

On the side close to the cutting teeth 30 of the blade 6, the carrier body 7 has formed thereon a slightly protruding seating edge 31 made of a plastics material whose cross-sectional profile Q tapers in the direction of the cutting blade 6. In the embodiment of FIGS. 1 and 3, the seating edge is formed to protrude relative to the upper side wall 33 and relative to the front side wall 34 of the carrier body 7, its cross-sectional profile Q being aligned at an acute angle relative to the cutting blade 6. As shown in FIG. 5, the cross-sectional profile Q of the seating edge 31 may also be of triangular shape, with a side wall extending in an elongation of the front side wall 34 of the carrier body 7, and, in projecting from the upper side wall 33 of the carrier body 7, may be formed integral therewith.

Figure 4:
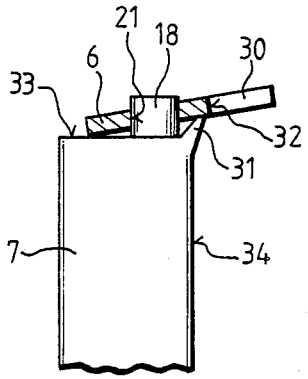
FIG. 4 is a view of the upper part of a carrier body with a cutting blade.

FIG. 4 shows the upper part of a carrier body 7 in preassembled condition, with a cutting blade 6 shown in section mounted thereon. The cutting blade 6 rests with its one end on the seating edge 31 and with its other end on the upper side wall 33 of the carrier body 7, with the tapering cross-sectional profile Q of the seating edge 31 abutting directly the root 32 of the cutting teeth 30. The driving member or members 18 formed on the upper side wall 33 on the carrier body 7 engage into receiving openings 21 provided in the cutting blade 18 for the purpose of picking up the blade.

In the assembly process of the long-hair trimmer in a cutting head frame according to FIG. 1 or a slide switch 35 according to FIG. 2, the cutting blade 6 executes a pivotal movement under the action of the force exerted by the pressure spring 8 or springs 8 on the carrier body 7, which force is transmitted to the blade via the seating edge 31. In the process, the cutting blade 6 lifts clear of the upper side wall 33, moving with its abutment surface 24 into engagement with the abutment surface 25 of the cutting comb 5 fixed to the housing 2. The cutting blade 6 is thus held in abutting engagement with the cutting comb 5 through the seating edge 31 exclusively. By means of the force exerted by the pressure spring or springs via the carrier body 7 to the seating edge 31 and the cutting blade 6, a deformation of the seating edge 31 made of a plastics material and of the cutting blade 6 occurs, its moment of resistance in the direction of action of the pressure springs 8 permitting it to flex slightly. The elastic and/or plastic deformation of the seating edge 31, in combination with the flexing of the cutting blade 6, results in an excellent engagement of the cutting blade with the cutting comb, in particular in the cutting area of the cutting teeth of blade and comb, resulting in a particularly good cutting action of the long-hair trimming device.

The embodiment of FIG. 3 shows the upper part of a switch slide 35 provided on a shaving apparatus and accommodating the long-hair trimming device, by means of which the long-hair trimming device may be provided in a manner enabling it to slide relative to the shaving apparatus. The longitudinal ends of the angled cutting comb 5 are fastened to the housing 2 of the switch slide 35—not shown in the sectional view. The carrier body 7 is slidably held between the housing wall 2.1 of the switch slide 35 and the angled wall 36 of the cutting comb 5. By means of pressure springs 8—of which only one is shown—which bear with their one ends against the support strip 4 of the housing wall 2.1 and with their other ends against the carrier body 7, the force exerted by these springs is transmitted to the cutting blade 6 via the seating edge 31. In the assembled state the cutting blade 6 coupled to the driving member 18—as shown—is supported only by the seating edge 31 formed on the carrier body. The seating edge which tapers in the direction of the cutting blade 6 rests against the cutting blade 6 in the area of the root 32, thus providing a good engagement between the abutment surfaces 24 and 25 of cutting blade and cutting comb, respectively, under the action of the force of the pressure springs 8, particularly in the cutting area of the cutting teeth 30 of the blade and the cutting teeth 37 of the comb. The seating edge 31 which is made of a plastics material extends along the entire length of cutting blade 6 and cutting comb 5, providing by means of elastic and plastic deformation as well as a slight flexing of the cutting blade an excellent relative engagement of the abutment surfaces 24 and 25 over their entire longitudinal extent, particularly in the cutting area of the cutting teeth 30 and 37.

To reduce the friction between the cutting blade 6 and the cutting comb 5, the sliding surface 25 has a U-shaped recess 38—FIG. 3—or a break which can be manufactured, for example, by correspondingly forming a cutting comb folded from a strip of sheet metal—FIG. 1.

List of References

1 Cutting Head Frame
2 Housing
2.1 Housing Wall
3 End Wall
4 Support Strip
5 Cutting Comb
6 Cutting Blade
7 Carrier Body
8 Pressure Spring (4)
9 Fork
10 Drive Means
11 Driving Pin
12 Cutting Foil
13 Screws or Rivets (2)

14 Molding (2)
15 Guide Strip
16 Recesses (4)
17 Groove
18 Driving Member
21 Receiving Openings
24 Abutment Surface of 6
25 Abutment Surface of 5
30 Cutting Teeth of Blade
31 Seating Edge
32 Root of Teeth
33 Upper Side Wall
34 Front Side Wall
35 Slide Switch
36 Wall of 5
37 Cutting Teeth of Comb 5
38 U-shaped Recess

We claim:

1. A long-hair trimming device for dry shaving apparatus, with a cutting comb (5) arranged fast with a housing (2) and having an abutment surface (25) for engagement with an abutment surface (24) of a cutting blade (6) which is coupled to a carrier body (7) via at least one driving member (18), the carrier body being adapted to be driven by a drive means (10), and with at least one pressure spring (8) bearing with one end against the carrier body (7) while its other end takes support upon the housing (2), characterized in that the carrier body (7) provides on the side close to the cutting teeth (30) of the cutting blade (6) a slightly protruding seating edge (31) made of a plastics material and having its cross-sectional profile (Q) tapering in the direction of the cutting blade (6), that the seating edge (31) rests against the cutting blade (6) along its entire longitudinal length in the area of the root (32) of the cutting teeth (30), and that relative abutting engagement of the cutting blade (6) and the cutting comb (5) can be accomplished by deformation of the seating edge (31) and the cutting blade (6) by means of the force the pressure spring (8) exerts through the carrier body (7) on the seating edge (31) and on the cutting blade (6).

2. The long-hair trimming device as claimed in claim 1, characterized in that the seating edge (31) is formed integral with the carrier body (7).

3. The long-hair trimming device as claimed in any one of the preceding claims, characterized in that the cross-sectional profiled (Q) of the seating edge (31) is triangular.

4. The long-hair trimming device as claimed in either claim 1 or 2, characterized in that the seating edge (31), in extending in an elongation of the side wall (34) of the carrier body (7), is provided on the upper side wall (33) thereof.

5. The long-hair trimming device as claimed in either claim 1 or 2, characterized in that the seating edge (31) is arranged to protrude relative to the upper side wall (33) and the front side wall (34).

6. The long-hair trimming device as claimed in claim 1, characterized in that the seating edge (31) is both elastically and plastically deformable.

7. The long-hair trimming device as claimed in claim 1, characterized in that the cutting blade (6) has a low moment of resistance in the direction of action of the pressure springs (8).

* * * * *